United States Patent [19]

Smith

[11] 4,247,044

[45] Jan. 27, 1981

[54] COMPRESSION OPERATED INJECTOR

[75] Inventor: Richard H. Smith, Birmingham, Mich.

[73] Assignee: General Motors Corporation, Detroit, Mich.

[21] Appl. No.: 107,054

[22] Filed: Dec. 26, 1979

[51] Int. Cl.[3] ..... F02M 49/02

[52] U.S. Cl. ..... 239/87; 239/585

[58] Field of Search ..... 239/87, 585; 123/139 R, 123/139 AU, 139 E, 139 AK, 139 AF

[56] References Cited

U.S. PATENT DOCUMENTS

| | | | |
|---|---|---|---|
| 2,572,118 | 10/1951 | Dickson | 123/139 AJ |
| 3,055,593 | 9/1962 | May et al. | 239/87 |
| 3,782,352 | 1/1974 | Sparber | 123/139 AJ |
| 3,919,989 | 11/1975 | Jarrett | 123/139 R |
| 4,197,996 | 4/1980 | Giardini | 239/585 X |

*Primary Examiner*—Andres Kashnikow

*Attorney, Agent, or Firm*—Arthur N. Krein

[57] ABSTRACT

In a compression operated injector, a solenoid valve is used to control the flow of pressurized fuel from a compression operated pump to the discharge nozzle of the injector so that the start and end of injection can be controlled by operation of the solenoid valve.

2 Claims, 1 Drawing Figure

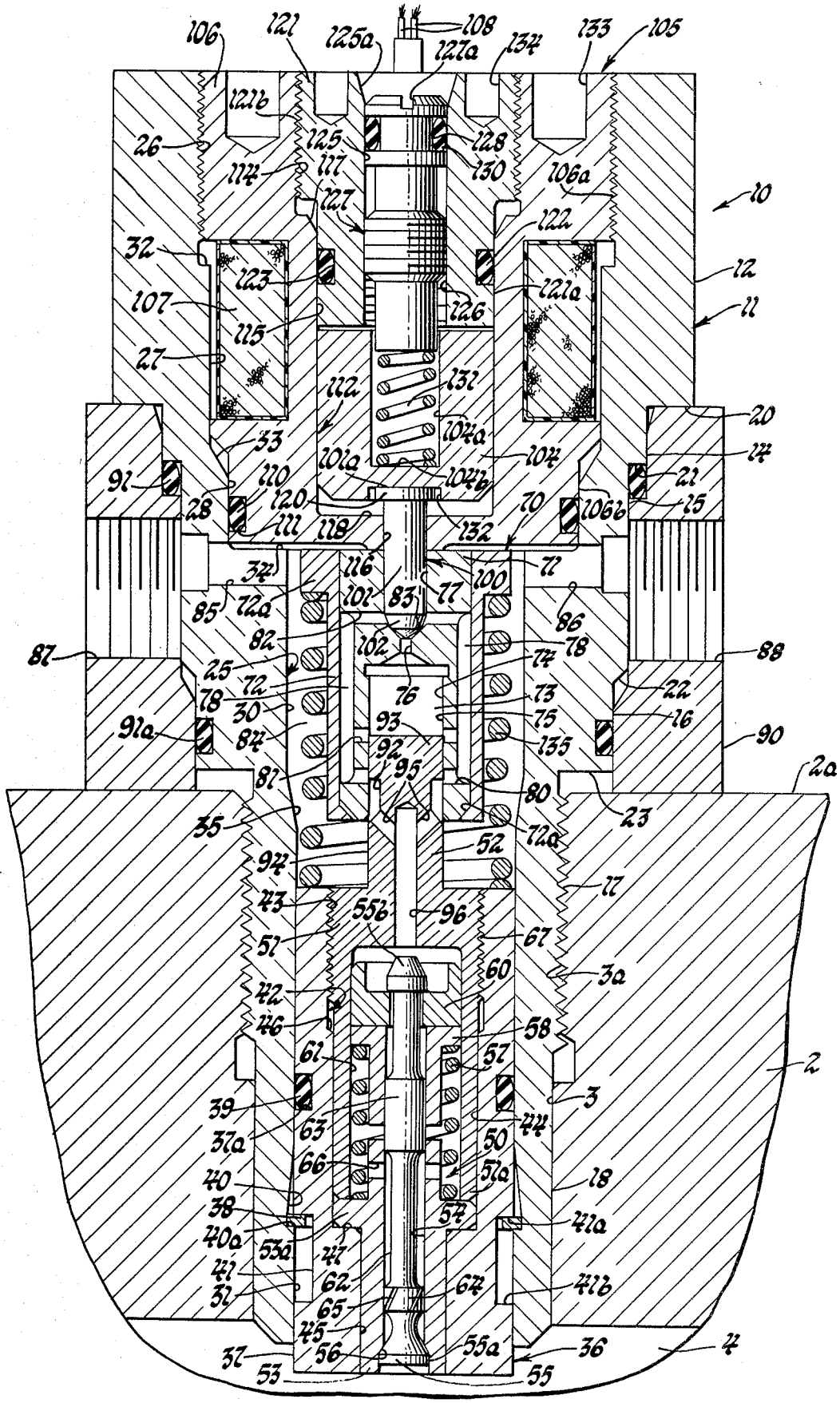

COMPRESSION OPERATED INJECTOR

This invention relates to unit fuel injectors for use in delivering fuel directly to the combustion chambers of an engine and, in particular, to such devices of the engine compression pressure operated type.

Engine compression pressure operated unit fuel injectors are well known in the prior art. Unit fuel injectors of this type include a pump unit having a piston positioned so as to be responsive to the combustion chamber pressure of an associated combustion chamber in an engine with the piston operating a pump plunger relative to a cylinder bushing in the injector assembly to create the necessary fuel pressure to effect injection of fuel through an injection valve nozzle assembly into the combustion chamber of the engine.

In such prior art compression operated injectors it has been conventional to provide mechanical means for controlling the start and end of an injection cycle whereby to also control the quantity of fuel being injected. Being mechanically controlled, such prior art injectors were limited as to their capabilities for the precise controlling of the start and end of injection and for the control of the quantity of fuel being injected.

In modern day engines it is now necessary and desirable to more closely control the operation of engines so as to reduce the emissions from such engines and to improve fuel economy. In this regard, it is well known in the gasoline internal combustion engine art to utilize electronic fuel injection because of its adaptability to effect more efficient operation of the engine whereby to improve fuel economy and emission control.

Accordingly this invention relates to a compression operated injector wherein a compression operated pump element is used to pressurize fuel and a solenoid valve is used to control the flow of such pressurized fuel to the injection nozzle of the assembly. The solenoid valve permits accurate control to effect the start and end of injection and therefore to precisely control the quantity of fuel being injected during each pulse injection period.

It is therefore a primary object of this invention to provide an improved compression operated injector wherein a solenoid valve is incorporated into the injector assembly so as to effect control of the injection fuel to a combustion chamber.

Another object of this invention is to provide an improved compression operated injector which is adapted to be operated by engine compression pressure and which has a solenoid valve means incorporated therein to control the actual discharge of such pressurized fuel.

Another object of this invention is to provide an improved compression operated injector having relatively few major components, which components are of relatively simple construction for economy of manufacture and convenience of assembly, and yet cooperate to provide an assembly which is trouble free in operation.

For a better understanding of the invention as well as other objects and further features thereof, reference is had to the following detailed description of the invention to be read in conjunction with the accompanying drawing, wherein:

The only FIGURE is a longitudinal cross-sectional view of a compression operated injector constructed in accordance with the invention and shown in assembled relationship in an opening provided therefore in an engine cylinder head.

Referring now to the drawing there is shown a portion of the cylinder head 2 of an engine having a stepped bore 3 extending therethrough to open into a combustion chamber 4 of the engine. As shown, the compression operated injector 10, constructed in accordance with the invention, is mounted to the cylinder head 2 so that its nozzle end projects into the combustion chamber 4.

The compression operated injector 10 includes a cylindrical, hollow, tubular injector body 11 adapted to house the remaining components of the injector assembly. In the construction illustrated, the injector body 11 is of stepped outer cylindrical configuration so as to define a cylindrical outer upper wall 12, a cylindrical intermediate upper wall 14, a cylindrical port wall 15, a cylindrical lower intermediate wall 16 and, a cylindrical lower wall which includes an upper externally threaded portion 17 and a terminal lower wall 18. These walls 12, 14, 15, 16, 17 and 18 are of progressively reduced outside diameters relative to each other in the order identified. As shown, the externally threaded portion 17 is sized so as to mate with the internally threaded portion 3*a* of bore 3 in the cylinder head 2 and the lower wall 18 is sized so as to be slidably received in the lowr portion of bore 3 in the cylinder head.

The upper wall 12 is interconnected with the intermediate upper wall 14 by flat shoulder 20. Intermediate upper wall 14 is interconnected to the port wall 15 by a flat shoulder 21. Port wall 15 is interconnected with the lower intermediate wall 16 by an inclined shoulder 22. Lower intermediate wall 16 is interconnected to the threaded portion 17 of the lower wall by a flat shoulder 23.

The injector body 11 is provided with an axial extending stepped through bore 25 to provide a cylindrical internally threaded upper wall 26, a cylindrical internally threaded upper wall 26, a cylindrical intermediate upper wall 27, a cylindrical lower intermediate wall 28, a cylindrical lower wall 30 and a piston receiving terminal wall 31. Walls 26, 27, 28, 30 and 31 are of progressively reduced internal diameters relative to each other in the order identified. In the construction shown, walls 26 and 27 are interconnected by a flat surface 32. Walls 27 and 28 are interconnected by an inclined surface 33. Walls 28 and 30 are interconnected by a flat surface 34. Walls 30 and 31 are interconnected by an inclined surface 35.

A cylindrical tubular piston 36 is reciprocably journaled in the injector body 11, the outside cylindrical surface 37 of the piston 36 being appropriately sized so as to be slidably received by the cylindrical lower wall 31 of the injector body whereby the piston will be exposed to the pressure in combustion chamber 4.

In the construction illustrated, axial movement of the piston in opposite directions in controlled by means of a split retainer ring 38 that is positioned in a suitable groove 40 provided in the lower wall 31 of the injector body for this purpose, the lower shoulder 40*a* provided by this groove in the injector body being located a predetermined distance, as desired, from the lower end of the injector body. To receive the retaining ring 38 and so as to provide a pair of opposed shoulders for abutment against the retaining ring, the piston 36 is formed with an annular groove recess 41 of predetermined axial extent whereby to provide the opposed flat abutment upper and lower shoulders 41*a* and 41*b*, respectively, with reference to the drawing.

The skirt portion of the piston 36 above recess 41 is provided with at least one external packing ring 39 positioned in a suitable groove 37*a* provided for this purpose in wall 37 whereby the packing ring 39 is slidable in the bore wall 31.

Piston 36 is of hollow tubular configuration with an axial stepped through bore 42 therein defining an upper internally threaded cylindrical wall 43, an intermediate cylindrical wall 44 and a cylindrical lower wall 45, with these walls being of progressively reduced inside diameters relative to each other in the order identified. Walls 43 and 44 are interconnected by an inclined surface 46 and, walls 44 and 45 are interconnected by a flat surface 47.

Positioned within the piston 36 so as to be carried thereby is a conventional nozzle assembly, generally designated 50, the injector nozzle assembly 50 being retained by means of a piston closure cap 51 which in the construction shown has a projecting plunger 52 formed integral therewith.

Although the injector nozzle 50 may be of any suitable type, in the construction illustrated it is of the type that includes an outward opening, poppet type injection valve. Thus in the construction shown, the injection nozzle 50 includes a tubular nozzle spray tip 53 with a bore 54 therethrough of a size so as to slidably receive a poppet type, nozzle valve 55. The head 55*a* of the valve 55 is adapted to seat against a conical valve seat 56 provided adjacent to the lower end of the bore 54 in nozzle spray tip 53. The nozzle valve 55 is normally biased whereby its head 55*a* seats against the valve seat 56 by means of a coil spring 57. As shown, one end of the coil spring 57 abuts against the radial flange 53*a* of the nozzle spry tip 53 while the opposite end of the spring 57 abuts against a spring retainer sleeve 58. The spring retainer sleeve 58 in turn is adapted to abut against a washer-like valve retainer collar 60 suitably fixed to the enlarged end 55*b* of the nozzle valve 55 opposite the head 55*a* thereof.

As shown, the piston closure cap 51 is provided with an enlarged bore opening at its lower end to define an internal cylindrical wall 61 of an internal diameter so as to loosely receive the spring retainer sleeve 58 and the valve retainer collar 60. The outside dimension of both the last two elements 58, 60 being sized relative to the bore wall 61 whereby to provide a suitable annular clearance therebetween for the axial flow of fuel as is conventional in this type injector nozzle.

The stem 62 of the nozzle valve 55 is provided with axial spaced apart upper and lower lands 63 and 64, respectively, both of an outside diameter so as to be slidably received by the wall bore 54, with the lower land 64 having spaced apart, axial extending spiral grooves 65 therein. Nozzle spray tip 53 is provided adjacent to its upper end with at least one radial through aperture 66 located so as to communicate with the wall of bore 54 at a location between the lands 63 and 64 of the valve stem 62, that is, at a location adjacent to the reduced diameter portion of the valve stem.

As shown, the piston closure cap 51 is suitably fixed to the piston 36, as by engagement of the external threads 67 of this cap with the upper threaded wall 43 of the piston, so that the lower end of the skirt 51*a* of the cap will but against one side of the flange 53*a* of the nozzle spray tip 53 whereby to force the other side of this flange into abutment against the surface 47 of piston 36.

In the construction illustrated, the piston closure cap 51 has a cylindrical plunger 52 formed integral therewith so that the plunger 52 extends upward from and concentric therewith. Plunger 52 is adapted to be reciprocably received in a pump bushing, generally designated 70, to form therewith a pump assembly.

To facilitate its manufacture the pump bushing 70, in the embodiment illustrated, is formed in two parts, including a cylindrical bushing 71 and a spring-bushing retainer sleeve 72. As shown, the spring-bushing retainer sleeve 72 is provided at its lower end with a radial inward extending inclined flange 72*a* against which the lower beveled end of the bushing 71 can abut, whereby the bushing 71 is retained against movement in one axial direction relative to the spring-bushing retainer sleeve 72.

The pump bushing 70 is suitably retained within the injector body 11 in a manner to be described in detail hereinafter whereby the pump bushing 70 cooperates with the plunger 52 to form a variable volume pump chamber 73. For this purpose, the bushing 71 is provided with a stepped through bore 74 to define, starting from the lower end of the bushing with reference to the drawing, an internal cylindrical wall 75 of a diameter to reciprocably receive the plunger 52, an intermediate cylindrical wall defining a discharge outlet 76 from the pump chamber 73 and a cylindrical upper wall 77 of a suitable internal diameter for a purpose to be described in detail hereinafter.

To provide for the ingress and egress of fuel to and from the pump chamber 73, the bushing 71, in the construction illustrated, is provided with two axial extending recessed slots 78 formed opposite each other in the outer peripheral surface thereof whereby to define fluid flow passages with the inner wall of the spring-bushing retainer sleeve 72. In addition, the bushing 71 is provided with radial ports 80 extending from the wall 75 to communicate with the lower end of the recessed slots 78, and with intermediate side ports 81 that extend from the wall 75 to intersect the slots 78 at a predetermined axial distance from the inlet ports 80. In addition, there is provided a radial through port 82 that is located in the bushing 71 so as to interconnect the opposite or upper end of the slots 78 with this port 82 also intersecting the wall 77 at a location above a conical valve seat 83 positioned so as to encircle the outlet 76 concentric therewith.

As shown, the pump bushing 70 is centrally located within the injector body 11 substantially concentric with the internal lower wall 30 thereof whereby to define therewith an annular fuel chamber 84. A fuel inlet port 85 and a fuel outlet port 86 are provided in the injector body so as to be in communication with the fuel chamber 84, the inlet port 85 being adapted to be connected by a conduit to a source of fuel, such as a fuel reservoir, both not shown, while the outlet port 86 is adapted to be connected to the fuel reservoir by a return conduit, not shown.

For this purpose, in the construction illustrated, the ports 83 and 86 are located diametrically opposite each other so as to be in fluid communication with internally threaded fuel inlet ports 87 and fuel outlet ports 88, respectively, provided in a connector collar 90 that encircles the injector body 11 and is suitably connected thereto. In the embodiment shown, this connector collar 90 is fixed to the injector body 11 being suitably sandwiched between the flat shoulder 20 of the injector body 11 and the upper surface 2a of the cylinder head 2. Annular seal rings 91 and 91a are used to effect fluid seals between the collar 90 and the exterior of the injector body 11 above and below the ports 85, 87 and ports 86, 88.

To effect communication between the fuel chamber 84 to the pump chamber 73 and between the pump chamber 73 to the nozzle assembly 50 via the flow passages previously described, the plunger 52 is provided with an annular recessed groove 92 which, in effect, divides the outer peripheral surface of the plunger whereby to form an upper land 93 and a lower land 94. The axial extent of the groove 92 and of each of the lands 93 and 94 are preselected so that when the plunger 52 is in the position shown, a fully retracted position relative to the bushing 71, opposed upper and lower ends of the groove 92 are in fluid communication with the radial ports 80 and the fuel chamber 84, respectively.

It will be apparent that upon upward movement of the plunger 52, as the lower land 94 moves upward opposite the internal wall 75 of bushing 71, the land will block flow communication with the fuel chamber 84. Prior to this upward movement, fuel admitted from the fuel chamber 84 can flow via the grooves 92, radial ports 80, recess slots 78 through the side ports 81 so that the pump chamber 73 can be supplied with fuel.

As the plunger 52 continues its upward movement the upper land 93 will then cover over the side ports 81 so that thereafter fuel within the fuel chamber 73 can be compressed. As this occurs, the groove 92 will come into full registry with the radial ports 80 whereby fuel as pressurized in the pump chamber 73 can then flow, as controlled in a manner to be described, out through the discharge outlet 76.

Referring again to the recessed groove 92 in plunger 52, this groove is also connected for flow communication with the nozzle assembly 50 by means of inclined ports 95, each such port extending from the recessed groove 92 so as to intersect an axial extending passage 96 provided in the piston closure cap 51. As shown, the passage 96 extends from the plunger 52 to open into cavity defined by the bore wall 61 in the piston closure cap 51.

Now in accordance with the invention, the flow of pressurized fuel from the pump chamber 73 to the nozzle assembly 50 is controlled by a normally closed, solenoid actuated valve that is positioned to control flow out through the discharge outlet 76. For this purpose, a valve 100 has a portion of its stem 101 slidably received in the portion of the stepped through bore 74 defined by the upper wall 77 so that the head 102 of this valve is positioned for movement between a seated and an unseated position relative to the valve seat 83, with this movement of the valve being controlled by the armature 104 of a solenoid assembly, generally designated 105.

The solenoid assembly 105 further includes a conventional tubular coil bobbin 106 supporting a magnetic wire solenoid coil 107 wrapped around it and which is connected by a pair of electrical leads 108 to a suitable source of electrical power via a conventional fuel injection electronic control circuit, not shown, whereby the solenoid can be energized as a function of operating conditions of the engine in a well known manner.

Bobbin 106 is supported within the stepped through bore 25 in the injector body 11 as by having the external threads 106a thereof engaged with the internally threaded upper wall 26 of the injector body. As thus positioned within the injector body 11, the lower reduced diameter end 106b of the bobbin 106 is slidably received by the lower intermediate wall 28 of the injector body. An annular seal ring 110 is positioned in a suitable annular groove 111 provided for this purpose on the bobbin 106 so as to effect a seal between the lower end of the bobbin and the lowr intermediate wall 28 of the injector body.

The bobbin 106, in the embodiment illustrated, is provided with a stepped through bore 112 so as to define, starting at its upper end with reference to the drawing, an internally threaded upper wall 114, an intermediate wall 115 and a lower wall 116, each of cylindrical configuration and of progressively reduced internal diameters. As shown, the internal diameter of wall 116 is selected so that the stem 101 of valve 100 can loosely extend upward therethrough whereby the head 120 of the valve is loosely received in the chamber defined by wall 115 in bobbin 106. Walls 114 and 115 are interconnected by an inclined shoulder 117. Walls 115 and 116 are interconnected by a flat shoulder 118.

A tubular solenoid core pole 121 is threaded at 121b to the internally threaded upper wall 114 of bobbin 106. The reduced diameter end 121a of the core pole 121 extends a predetermined distance into the bore wall 115 of the bobbin 106 to serve as a stop for limiting axial movement of the armature 104 in one direction, upward as seen in the drawing, when the solenoid is energized. An annular seal ring 122 positioned in an annular groove 123 provided in the end 121a of the core pole is used to effect a seal between the core pole 121 and the bore wall 115.

The core pole 121 is formed with a central through bore to define an upper cylindrical wall 125 which in the construction illustrated includes an upper tapered portion 125a and a lower internally threaded wall portion 126. A spring adjusting screw 127, having a tool receiving slot 127a, for example, at its upper end is adjustably received in the bore of the core pole 121. Preferably as shown, the screw 127 adjacent to its upper end is provided with a recessed groove 128 in which a ring seal 130 is positioned to effect a seal between the screw and the bore wall 125.

The armature 104 and therefore the valve 100 are normally biased in the opposite direction, that is, in a downward direction to the position shown by a compression spring 131. For this purpose, the armature 104 is provided with a blind bore 104a of a suitable diameter so as to loosely receive the spring 131 and the lower reduced diameter end of the screw 127. With this arrangement, the spring 131 is positioned so that one end thereof abuts against the lower free end of the screw 127 while the opposite end of the spring abuts against an internal shoulder 104b of the armature.

Preferably as shown, the armature 104 at its lower end, with reference to the drawing, is provided with an enlarged circular recess 132 of a size so as to loosely receive the enlarged stem end 101a of the valve 100.

With the solenoid assembly 105 thus assembled to the injector body 11, the valve 100 is positioned substantially co-axial with the axes of the bore 25 in the valve body so that the stem 101 of the valve slidably projecting through the upper wall 77 of the bushing 71 will effect centering of the pump bushing 70 assembly.

Also, as shown, a compression spring 135 is positioned so as to encircle the lower end of the pump bushing 70 with one end of the spring 135 abutting against the radial flange 72*a* of the spring-bushing retainer sleeve 72 while the opposite end of the spring 135 abuts against the upper surface of the piston 36. With this arrangement, the pump bushing 70 is normally biased into abutment against the lower surface of the coil bobbin 106 while the piston 36 is normally biased downward to the position shown, a position at which the abutment shoulder 41*a* of the piston abuts against the retainer 38.

As shown, both the coil bobbin 106 and the core pole 121 may be provided with sets of blind apertures 133 and 134, respectively, whereby suitable spanner wrenches, not shown, may be used to apply torque to these respective elements during assembly of the injector.

During engine operation, fuel would be supplied from a fuel reservoir, not shown, in a suitable amount in excess of that required for injection by injector 10 via the inlet port 85 to the fuel chamber 84 therein at a suitable low supply pressure, as desired, with any excess fuel then being discharged via the outlet port 86. It will also be apparent that fuel can flow into and out of the fuel chamber 84 with piston 36 motion. As previously described, fuel from the fuel chamber 84 can also flow via the passage means described into the pump chamber 73.

The piston 36 is fired upward, against the biasing force of the spring 135, from the position shown, by the engine cylinder gas pressure in the combustion chamber 4 during a compression stroke of the piston, not shown, associated therewith. As this occurs, as the plunger 52 moves upward it will close off the previous flow communication between the fuel chamber 84 and pump chamber 73, in the manner previously described, with the upper land 93 then also blocking off the side ports 81 so that the pressure of the fuel in the pump chamber 73 will increase upon continued upward movement of the piston 36.

The pressure in the pump chamber 73 will increase until this pressure is sufficient to balance the engine cylinder pressure in the combustion chamber 4 acting on the exposed larger area of the piston 36. However, the pressure in the pump chamber 73 cannot communicate with the nozzle assembly 50 until the solenoid 105 is activated to permit unseating of the valve 100.

When the solenoid 105 is energized, as desired, the pressure of the fuel in the pump chamber 73 can effect unseating of the valve 100 to then allow pressurized fuel from the pump chamber 73 to flow to the nozzle assembly 50 which is then operative in a normal manner to effect injection of fuel into the combustion chamber 4.

When the solenoid assembly 105 is again deactivated, the valve 100 is again forced into seating engagement against the valve seat 83 to block the discharge of fuel from the pump chamber 73 via the discharge outlet 76. As this occurs the nozzle valve 55 will again seat against the valve seat 56 to stop the injection of fuel into the combustion chamber. At the same time, if the piston 36 is still on an upward stroke, the pressure in the pump chamber 73 will again balance the engine cylinder pressure acting on the piston 36 so that the travel of the piston 36 is again stopped.

Of course, when the pressure in the combustion chamber 4 decreases sufficiently, the spring 135 can again force the piston 36 downward, to the position shown, thus effecting a suction stroke of the plunger 52 relative to the bushing 71 to again allow the pump chamber 73 to be filled with a supply of low pressure fuel.

The embodiments of the invention in which an exclusive property or privilege is claimed are defined as follows:

1. A pressure operated fuel injection for delivering fuel directly to an engine combustion chamber, said injector device including an injector body having an axial stepped bore extending from an inboard end to an outboard end thereof relative to the combustion chamber; a solenoid valve means including a movable valve positioned in the outboard end of said bore; an actuator piston slidably positioned in the inboard end of said bore; a pump bushing means positioned in said bore intermediate said actuator piston and said solenoid valve means to define with said injector body a fuel supply chamber connectable to a source of fuel; said bushing having a stepped bore therethrough defining at one end a pump cylinder, at its other end a valve guide passage slidably receiving said valve with an intermediate valve seat for cooperation with said valve controlling encircling the bore opening to said pump cylinder; an injector nozzle means having an inlet and an outlet mounted in one end of said actuator piston with said outlet positioned for discharging fuel to the combustion chamber; a plunger fixed to the opposite end of said actuator piston for movement therewith with the free end of said plunger being slidably received in the pump cylinder of said pump bushing means; passage means in said plunger in communication with said inlet; cooperating passages in said bushing in fluid communication with said valve guide passage and positioned for cooperating with said passage means of said plunger for intermittently establishing communication between said passages and said fuel supply chamber upon relative movement of said plunger in said pump cylinder; and, means including a spring for causing and limiting outward movement of said actuator piston with respect to said injector body; said solenoid valve means being operative to effect movement of said valve in said valve guide passage relative to said valve seat to control the flow of pressurized fuel from said pump cylinder to said injector nozzle means during a pump stroke of said plunger whereby the start and end of fuel injection is controlled by operation of the solenoid valve means.

2. A pressure operated fuel injector for an engine comprising a hollow injector body having an inlet port and an outlet port for fuel; a piston slidable in one end of said injector body; said piston having an upstanding plunger at one end thereof and a fuel injection nozzle at its opposite end positioned for the discharge of fuel from said injector body; means including a spring operatively positioned in said injector body for causing and limiting outward movement of said piston with respect to said injector body and for limiting inward movement of said piston; a pump bushing means with a pump cylinder extending from one end thereof operatively positioned in said injector body to define with said plunger a pump chamber; said pump bushing means defining with said injector body an annular fuel supply chamber in communication with both said inlet port and said outlet port; passage means including inlet ports and a discharge port in said pump bushing means in communication with said pump chamber, control passage means including an annular groove in said plunger in communication with said fuel injection nozzle and cooperating with said passage means for intermittently establishing communication between said fuel supply chamber and said pump chamber and between said pump chamber and said fuel injection nozzle upon axial movement of said piston relative to said injector body; and, a solenoid actuated valve operatively positioned in the opposite end of said injector body to control flow from said pump chamber out through said discharge port.

* * * * *

UNITED STATES PATENT AND TRADEMARK OFFICE

CERTIFICATE OF CORRECTION

PATENT NO. : 4,247,044

DATED : January 27, 1981

INVENTOR(S) : Richard H. Smith

It is certified that error appears in the above-identified patent and that said Letters Patent are hereby corrected as shown below:

Column 2, line 26, "lowr" should read -- lower --.

Column 2, lines 39 and 40, after "26," delete "a cylindrical internally threaded upper wall 26,".

Column 2, line 58, "in" should read -- is --.

Column 3, line 37, "spry" should read -- spray --.

Column 4, line 68, after "11" insert -- by --.

Column 6, line 9, "lowr" should read -- lower --.

Column 8, lines 18 and 19, after "valve" delete "controlling".

Signed and Sealed this

*Seventh* Day of *July 1981*

[SEAL]

*Attest:*

RENE D. TEGTMEYER

*Attesting Officer* *Acting Commissioner of Patents and Trademarks*